US011489302B2

(12) United States Patent
Zeng et al.

(10) Patent No.: US 11,489,302 B2
(45) Date of Patent: Nov. 1, 2022

(54) TELESCOPIC MECHANISM OF EUROPEAN PLUG OF POWER CONVERTER WITH GROUNDING PIN

(71) Applicant: Dongguan Best Travel Electronics Co.,Ltd., Dongguan (CN)

(72) Inventors: Guangli Zeng, Dongguan (CN); Chengbing Wang, Dongguan (CN); Feng Wang, Dongguan (CN)

( * ) Notice: Subject to any disclaimer, the term of this patent is extended or adjusted under 35 U.S.C. 154(b) by 0 days.

(21) Appl. No.: 17/228,610

(22) Filed: Apr. 12, 2021

(65) Prior Publication Data

US 2021/0320467 A1 Oct. 14, 2021

(30) Foreign Application Priority Data

Apr. 13, 2020 (CN) ..... 202010285974.4
Apr. 7, 2021 (CN) ..... 202110372273.9

(51) Int. Cl.
*H01R 27/00* (2006.01)
*H01R 31/06* (2006.01)
*H01R 24/70* (2011.01)

(52) U.S. Cl.
CPC ..... *H01R 27/00* (2013.01); *H01R 31/06* (2013.01); *H01R 24/70* (2013.01)

(58) Field of Classification Search
CPC ..... H01R 27/00; H01R 31/06; H01R 24/68; H01R 24/70; H01R 24/00; H01R 13/60; H01R 13/40; H01R 13/45; H01R 13/66; H01R 4/66
See application file for complete search history.

(56) References Cited

U.S. PATENT DOCUMENTS 6,939,150 B1 * 9/2005 Lanni ..... H01R 35/04 439/174
7,894,198 B2 * 2/2011 Zhu ..... H05K 5/0278 361/755
8,182,276 B2 * 5/2012 Ruffner ..... H01R 24/22 439/172
9,313,303 B2 * 4/2016 Hu ..... H04M 1/026
10,862,255 B2 * 12/2020 Barnett ..... H01R 31/06

FOREIGN PATENT DOCUMENTS

CN 107959201 A * 4/2018 ..... H01R 13/46

* cited by examiner

*Primary Examiner* — Briggitte R. Hammond

(57) ABSTRACT

A telescopic mechanism of an European plug of a power converter with a grounding pin, including a shell, a push handle arranged on the shell, a plug bush arranged in the shell and movably connected with the push handle, a pin assembly arranged in the shell, a fixed rack arranged on the shell and extending into the plug bush, a movable rack connected with the pin assembly, and a gear arranged on the plug bush and meshed with the fixed rack and the movable rack respectively. The pin assembly includes two pins; two ground conductors are arranged on the plug bush, the two pins and the two ground conductors are combined to form a hybrid grounding plug, and an additional contact sleeve is provided on the hybrid grounding plug for a grounding pin of a French plug.

12 Claims, 12 Drawing Sheets

TELESCOPIC MECHANISM OF EUROPEAN PLUG OF POWER CONVERTER WITH GROUNDING PIN

TECHNICAL FIELD

The invention relates to the field of conversion plugs, in particular to a telescopic mechanism of an European plug of a power converter with a grounding pin.

BACKGROUND ART

With the increasing global tourism and trade, travel conversion plugs or travel converters have been widely used. With the development of technology, the types and functions of conversion plugs are constantly updated, for example, German conversion plugs.

However, due to the limitation of the internal structure design, the German conversion plug has the following disadvantages: when pins are pushed out for use, a push handle needs to be pushed to move for a stroke to push an plug bush to pass out of the shell; then, the push handle is pushed to move for a next stroke, so that the pins can be pushed out of the shell and out of a lower end of the plug bush for use. Therefore, with the structure having a large position and space to be reserved on the German conversion plug, the push handle can complete two strokes. Therefore, the occupied space is larger, and the size of the product is bigger, which dos not facilitate the miniaturization development of the product.

SUMMARY OF THE INVENTION

For the defects above, the invention is directed to provide telescopic mechanism of an European plug of a power converter with a grounding pin, wherein the stroke of the push handle can be set to be shorter when the plug bush and the pin assembly are pushed out similarly, so that the space occupied by the movement of the push handle is reduced, the inner space of a product is saved, and the size of the product is reduced conveniently, which facilitates the miniaturization of the whole product.

The technical solution adopted by the invention for achieving the above purpose is as follows.

A telescopic mechanism of an European plug of a power converter with a grounding pin comprises a shell, a push handle arranged on the shell, a plug bush arranged in the shell and movably connected with the push handle, and a pin assembly arranged in the shell, characterized by further comprising a fixed rack arranged on the shell and extending into the plug bush, a movable rack connected with the pin assembly. and a gear arranged on the plug bush and meshed with the fixed rack and the movable rack respectively.

As a further improvement of the present invention, the pin assembly comprises two pins, two ground conductors are arranged on the plug bush, the two pins and the two ground conductors are combined to form a hybrid grounding plug, and an additional contact sleeve is provided on the hybrid grounding plug for a grounding pin of a French plug.

As a further improvement of the present invention, the movable rack is fixedly connected with the pin assembly.

As a further improvement of the invention, the pin assembly further comprises a transverse connection block, and the two pins are perpendicularly arranged at a lower end of the transverse connection block, wherein the movable rack is fixedly connected with the transverse connection block.

As a further improvement of the present invention, the gear is fixed to the plug bush.

As a further improvement of the present invention, the gear is fixed to the plug bush by a screw.

As a further improvement of the present invention, the shell comprises a base and an upper cover matched with the base, wherein an opening through which the plug bush and the pin assembly pass is formed in the base.

As a further improvement of the present invention, the fixed rack is integrally formed on the base, or longitudinally and fixedly mounted on the base by a connector.

As a further improvement of the present invention, the fixed rack is longitudinally fixed to the upper cover.

As a further improvement of the invention, a locking structure is arranged between the push handle and the movable rack and comprises at least one locking protrusion arranged on the push handle and at least one locking slot formed on the movable rack and used for clamping the locking protrusion.

As a further improvement of the invention, the push handle is movably connected with the plug bush by a positioning seat, and a positioning slide hole and a spring mounting slot are respectively formed in the positioning seat; and a positioning strip which is slidably arranged in the positioning slide hole and a push block which is movable in the spring mounting slot are formed in the push handle, and a spring is arranged in the spring mounting slot.

As a further improvement of the invention, the push handle mainly consists of a linkage block arranged in the shell and a push part connected to an end of the linkage block and passing out of the shell, wherein the linkage block is movably connected with the plug bush by the positioning seat; the locking protrusion, the positioning strip and the push block are all arranged on the linkage block; meanwhile, a strip-shaped hole for the push part to move up and down is formed in the shell.

As a further improvement of the invention, at least one guide rod is arranged in the shell, and the linkage block and the positioning seat are sleeved on the guide rod.

The invention has following beneficial effects. By additionally arranging and combining the fixed rack, the gear and the movable rack meshed with each other, as long as the push handle is pushed downwards to move for a first stroke, the first downward stroke can be provided for the plug bush and the pin assembly, namely the plug bush and the pin assembly are pushed out of the shell synchronously; meanwhile, the pin assembly can also acquire a second stroke which moves downwards relative to the plug bush, so that the lower end of the pin assembly passes out of the plug bush, i.e. the push handle moves for one stroke, and the pin assembly can acquire two strokes. As can be seen from this, the stroke of the push handle can be set to be shorter when the plug bush and the pin assembly are pushed out similarly, so that the space occupied by the movement of the push handle is reduced, the inner space of a product is saved, and the size of the product is reduced conveniently, which facilitates the miniaturization of the whole product.

The above is an overview of the technical scheme of the invention. The following is a further explanation of the invention in combination with the attached drawings and specific implementations.

DETAILED DESCRIPTION OF THE INVENTION

In order to further explain the technical means and effects of the present invention for achieving the intended purpose, the following detailed description of the embodiments of the present invention will be made with reference to the accompanying drawings and preferred embodiments.

Embodiment 1

Figure 1:
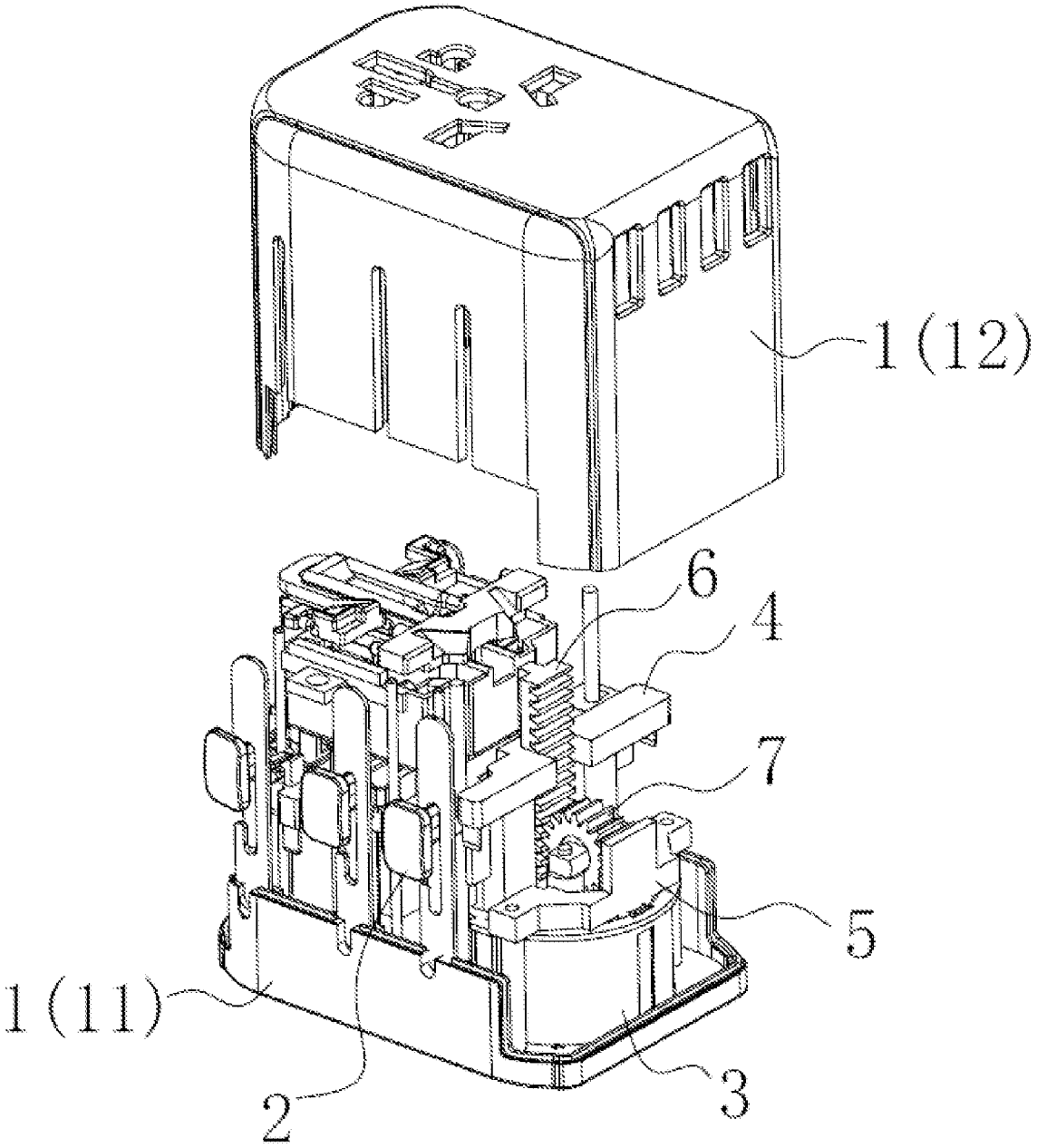
FIG. 1 is an overall exploded view according to Embodiment 1.
Figure 2:
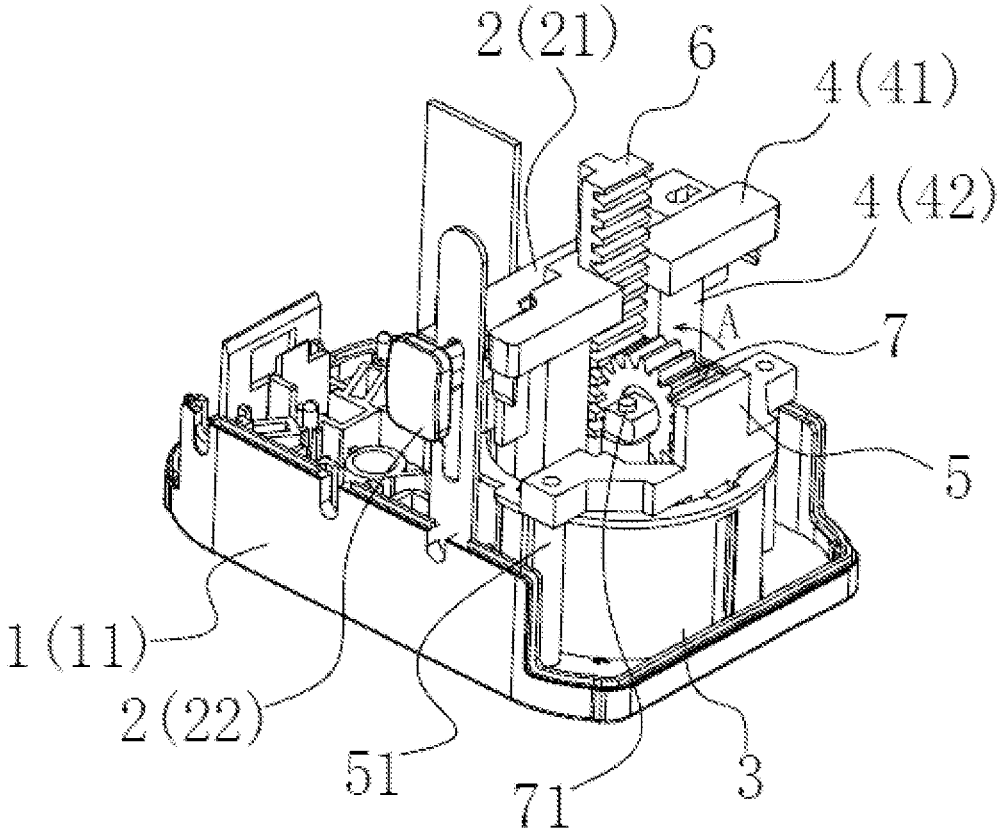
FIG. 2 is a schematic view showing the internal structure of a plug bush and a pin assembly in a non-push-out state according to Embodiment 1.
Figure 4:
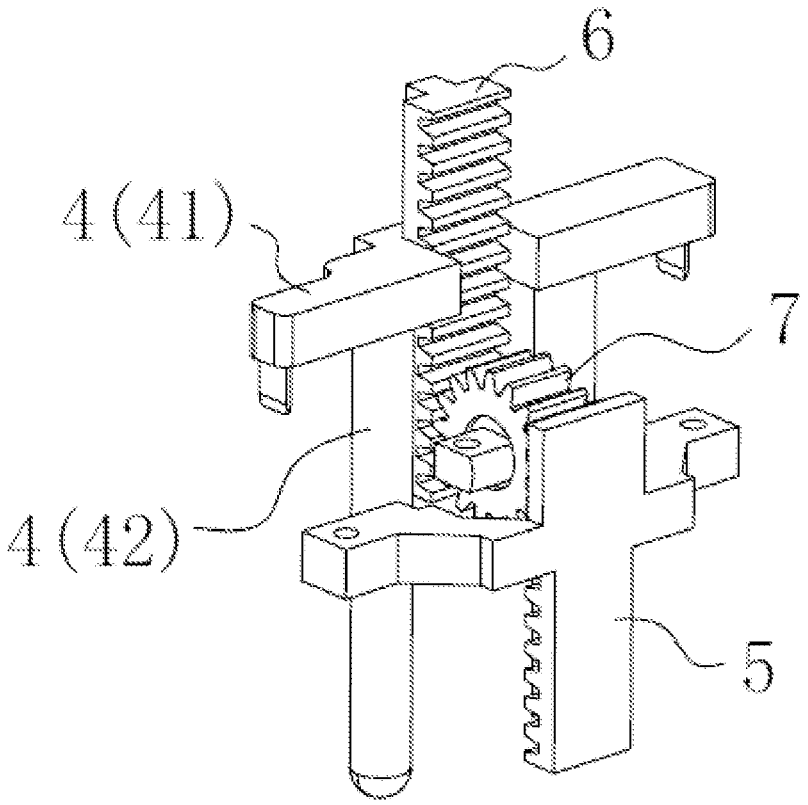
FIG. 4 is a schematic view showing the structure that a movable rack, a gear and a fixed rack are combined when the plug bush and the pin assembly are in the non-push-out state according to Embodiment 1.
Figure 5:
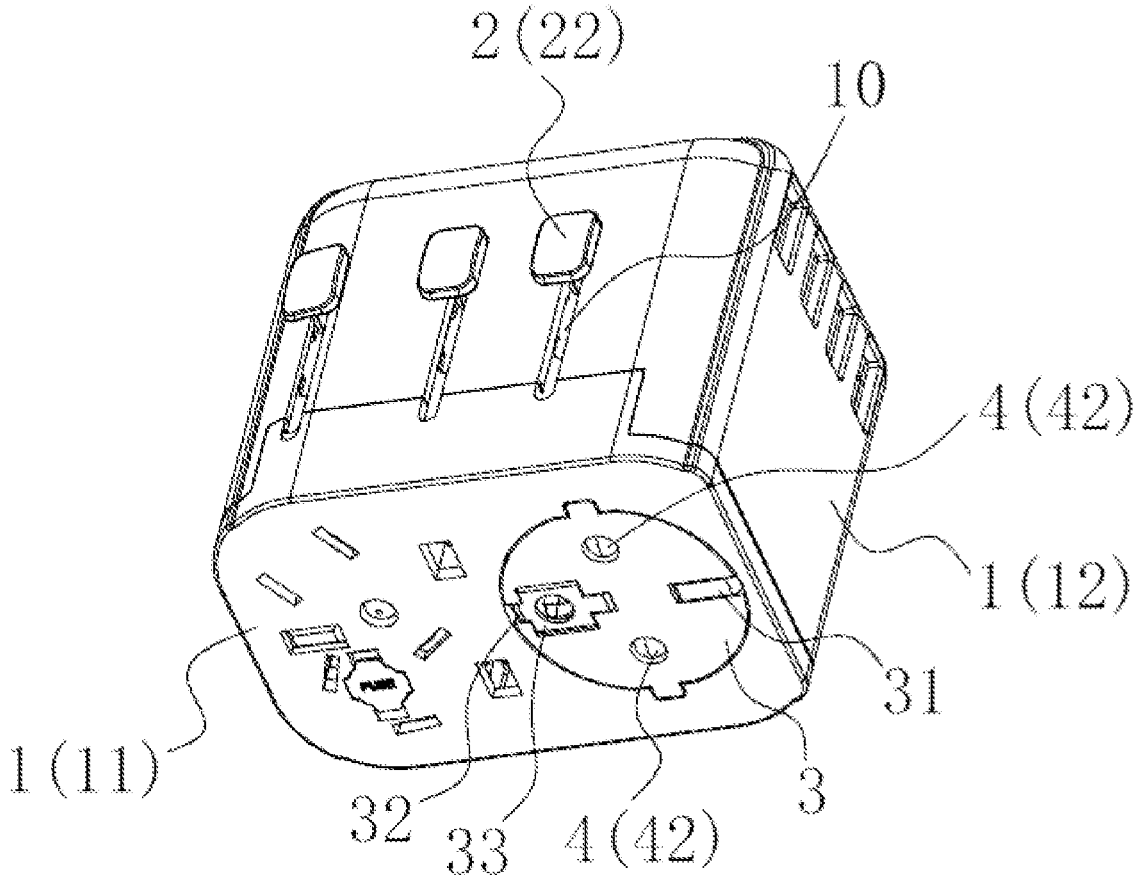
FIG. 5 is a schematic view showing the overall external structure of the plug bush and pin assembly in the non-push-out state according to Embodiment 1.
Figure 6:
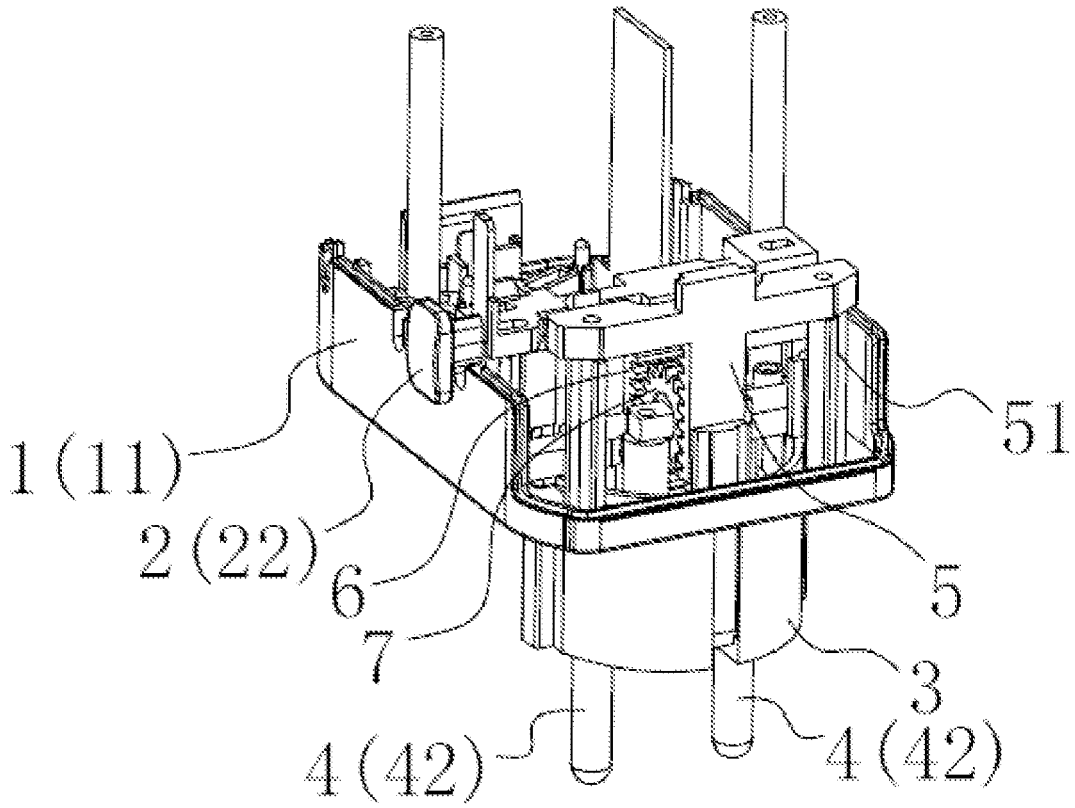
FIG. 6 is a schematic view showing the internal structure of the plug bush and the pin assembly in a push-out state according to Embodiment 1.
Figure 7:
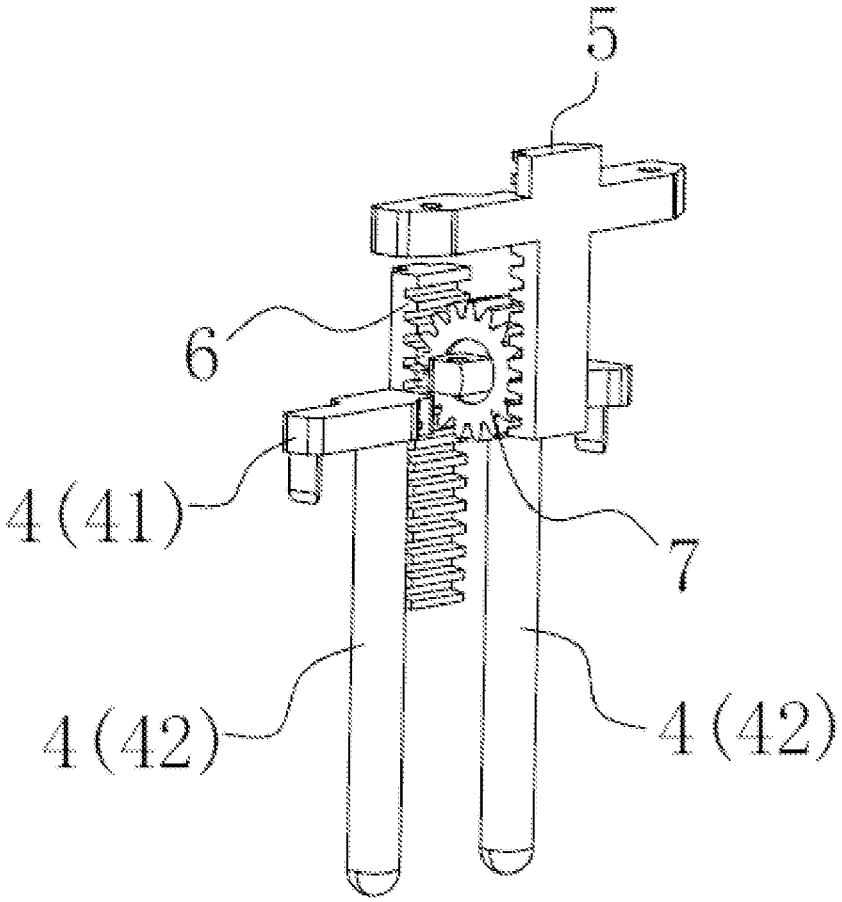
FIG. 7 is a structurally schematic view of the movable rack, the gear and the fixed rack are combined when the plug bush and the pin assembly are in the push-out state according to Embodiment 1.
Figure 8:
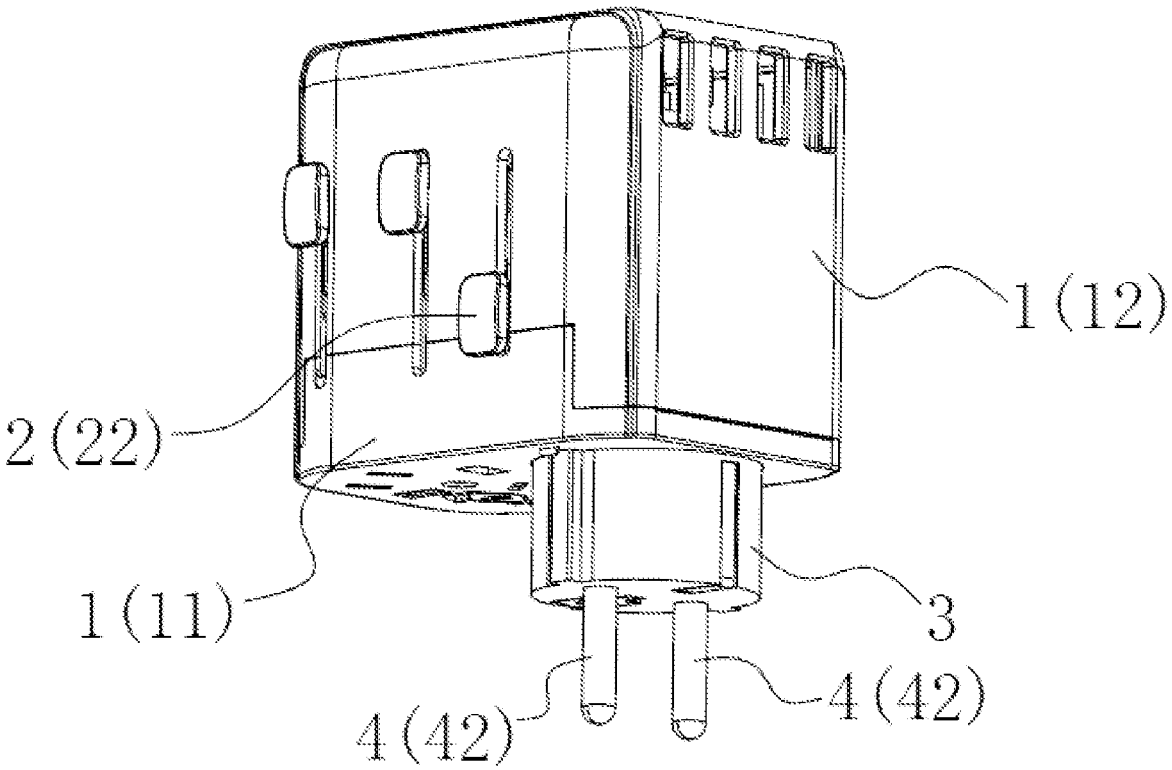
FIG. 8 is a schematic view showing the overall external structure of the plug bush and the pin assembly in the push-out state according to Embodiment 1.

Referring to FIGS. 1, 2 and 4, the present embodiment provides a telescopic mechanism of an European plug of a power converter with a grounding pin, comprising a shell 1, a push handle 2 arranged on the shell 1, a plug bush 3 arranged in the shell 1 and movably connected with the push handle 2, and a pin assembly 4 arranged in the shell 1. The telescopic mechanism of the European plug of the power converter with the grounding pin in the embodiment further comprises a fixed rack 5 arranged on the shell 1 and extending into the plug bush 3, a movable rack 6 connected with the pin assembly 4, and a gear 7 arranged on the plug bush 3 and meshed with the fixed rack 5 and the movable rack 6 respectively. As shown in FIGS. 2, 4 and 5, the plug bush 3 and the pin assembly 4 are in a non-push-out state. When the push handle 2 is pushed downwards, the push handle 2 drives the plug bush 3 to move downwards, and the gear 7 on the plug bush 3 moves downwards. Since the fixed rack 5 is fixed on the shell 1, the continuously moved gear 7 can roll along the fixed rack 5, for example, rotate in direction A (counterclockwise) in FIG. 2. In the process, as the gear 7 is in meshed connection with the movable rack 6, the movable rack 6 is also driven to synchronously move downwards when the gear 7 continuously moves downwards along with the plug bush 3 and passes out of the shell 1, and then the movable rack 6 drives the pin assembly 4 to synchronously move downwards for a first stroke, so that the pin assembly 4 and the plug bush 3 synchronously pass out of the shell 1; meanwhile, when the gear 7 rotates due to the presence of the fixed rack 5, the gear 7 synchronously pushes the movable rack 6 meshed with the gear 7 downwards, the movable rack 6 drives the pin assembly 4 to synchronously move downwards for a second stroke, and the pin assembly 4 moves downwards for the second stroke relative to the plug bush 3, so that a lower end of the pin assembly 4 passes out of the plug bush 3, as shown in FIGS. 6-8.

Therefore, as long as the push handle 2 is pushed downwards to move for the first stroke, the first downward stroke can be provided for the plug bush 3 and the pin assembly 4, namely the plug bush 3 and the pin assembly 4 are pushed out of the shell 1 synchronously; meanwhile, the pin assembly 4 can also acquire a second stroke which moves downwards relative to the plug bush 3, so that the lower end of the pin assembly 4 passes out of the plug bush 3, i.e. the pin assembly 4 can acquire two strokes. As can be seen from this, the stroke of the push handle 2 can be set to be shorter when the plug bush 3 and the pin assembly 4 are pushed out similarly, so that the space occupied by the movement of the push handle 2 is reduced, the inner space of a product is saved, and the size of the product is reduced conveniently, which facilitates the miniaturization of the whole product.

Figure 9:
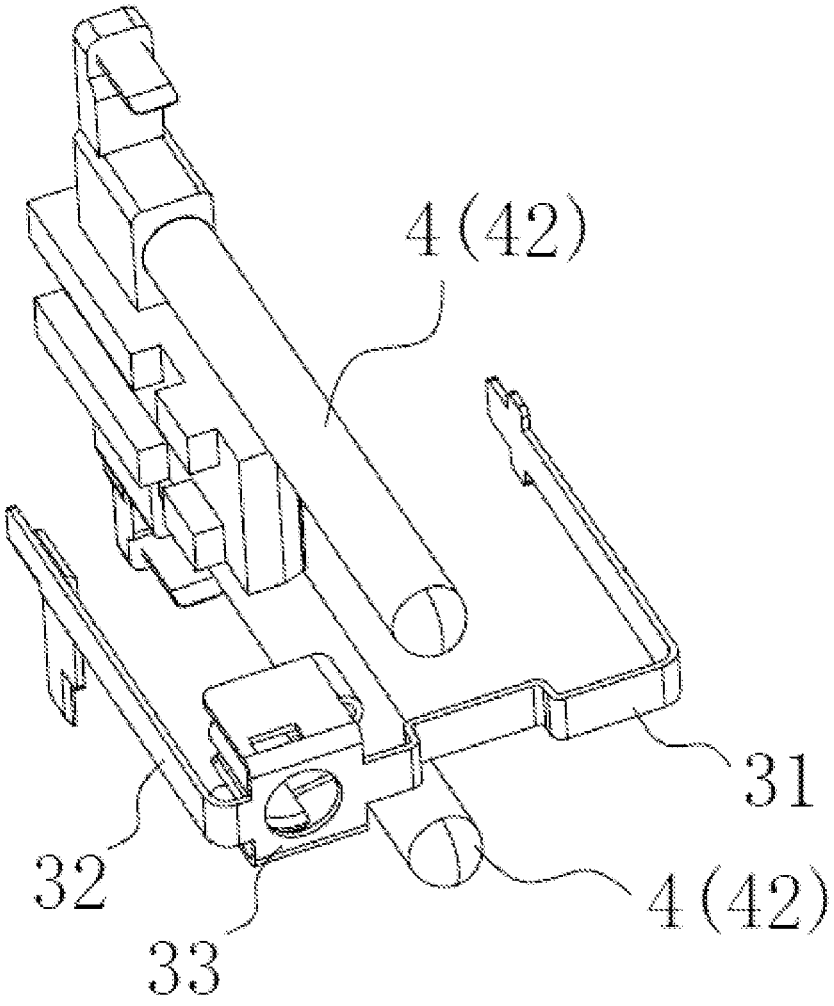
FIG. 9 is a structurally schematic view of a hybrid grounding plug according to Embodiment 1.

In this embodiment, as shown in FIGS. 5 and 9, the pin assembly 4 comprises two pins 42, two ground conductors 31, 32 are arranged on the plug bush 3, the two pins 42 and the two ground conductors 31, 32 are combined to form a hybrid grounding plug, and an additional contact sleeve 33 is provided on the hybrid grounding plug for a grounding pin of a French plug. By means of the meshed structure formed by combining the fixed rack 5, the movable rack 6 and the gear 7, the pin in the hybrid grounding plug can be telescopically operated.

In this embodiment, the movable rack 6 is fixedly connected with the pin assembly 4. Specifically, as shown in FIG. 2, the pin assembly 4 further comprises a transverse connection block 41, and the two pins 42 are perpendicularly arranged at a lower end of the transverse connection block 41, wherein the movable rack 6 is fixedly connected with the transverse connection block 41. Therefore, the movable rack 6 is integrally connected with the transverse connection block 41, and when the movable rack 6 moves downwards, the pin assembly 4 is driven to move downwards synchronously.

In this embodiment, the gear 7 is fixed to the plug bush 3. Specifically, as shown in FIG. 2, the gear 7 is fixed to the plug bush 3 by a screw 71. Of course, the gear 7 may be fixed to the plug bush 3 by other structures or other means. Therefore, the gear 7 is integrally connected with the plug bush 3, and when the plug bush 3 moves downwards, the gear 7 is driven to move downwards synchronously.

In the embodiment, as shown in FIG. 1, the shell 1 comprises a base 11 and an upper cover 12 matched with the base 11, wherein an opening through which the plug bush 3 and the pin assembly 4 pass is formed in the base 11; and when the plug bush 3 and the pin assembly 4 are not pushed out, lower end surfaces of the plug bush 3 and the pin assembly 4 are flush with the opening, as shown in FIG. 5. After the plug bush 3 and the pin assembly 4 are pushed out, lower parts of the plug bush 3 and the pin assembly 4 pass out of a lower end surface of the base 11 through the opening, as shown in FIG. 8.

For the specific mounting of the fixed rack 5, it may be integrally formed on the base 11, or the fixed rack 5 may be longitudinally and fixedly mounted on the base 11 by a connector 51, so that the gear 7 can be meshed with the fixed rack 5, and the gear 7 can roll up and down along the fixed rack 5, as shown in FIG. 2. The specific structure and configuration of the connector 51 can be set according to specific requirements, as shown in FIGS. 2 and 6. Of course, it is also possible to fix the fixed rack 5 longitudinally on the upper cover 12 as long as the fixed rack 5 can extend to the side of the gear 7 for being meshed with the gear 7, and the gear 7 can roll up and down along the fixed rack 5.

The telescopic mechanism provided by the embodiment of the invention is particularly suitable for a conversion plug, and the synchronous push-out function is realized for the plug bush 3 and the pin assembly 4 in the plug. During specific operations, the plug bush 3 and the pin assembly 4 can be pushed out only by pushing the push handle 2 downwards, and the plug bush 3 and the pin assembly 4 can be retracted by pushing the push handle 2 upwards. However, with regard to other structures and working principles inside the conversion plug, the same is true of the conventional conversion plug in the art.

Preferably, the telescopic mechanism provided by the embodiment is particularly suitable for use in European conversion plugs, such as German or French conversion plugs, particularly for use in high power appliances below 16 A.

Embodiment 2

Figure 10:
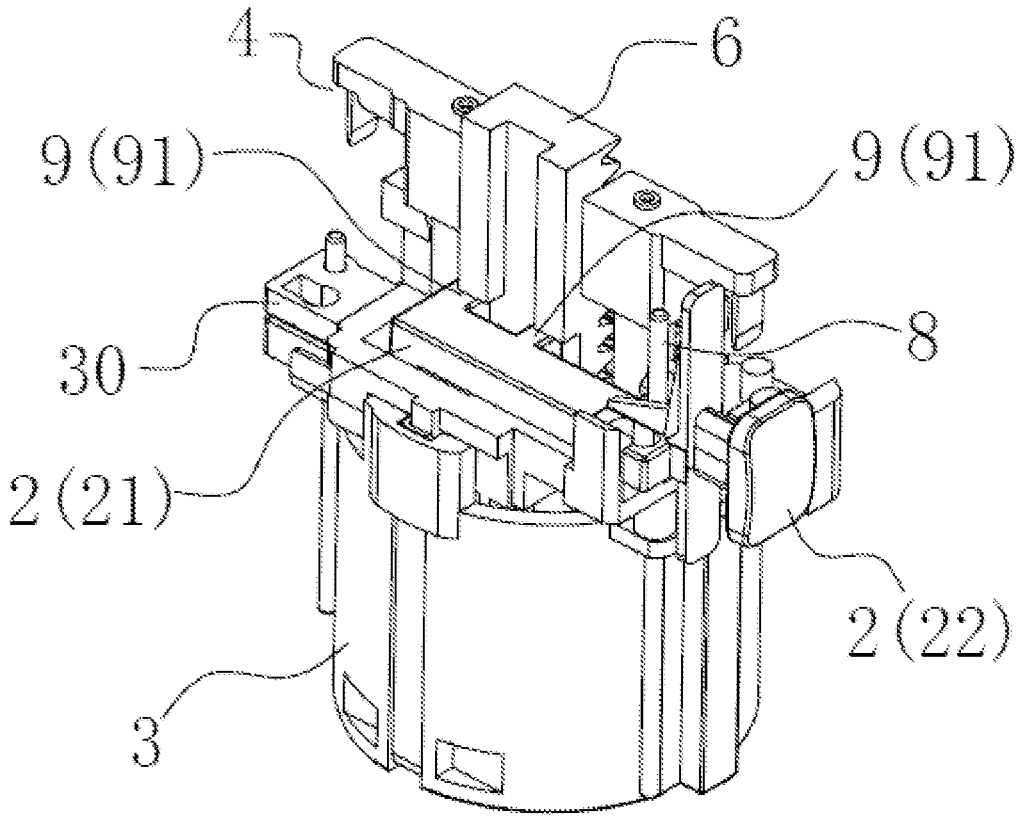
FIG. 10 is a structurally schematic view of a locking structure arranged on a push handle and a movable rack according to Embodiment 2.
Figure 11:
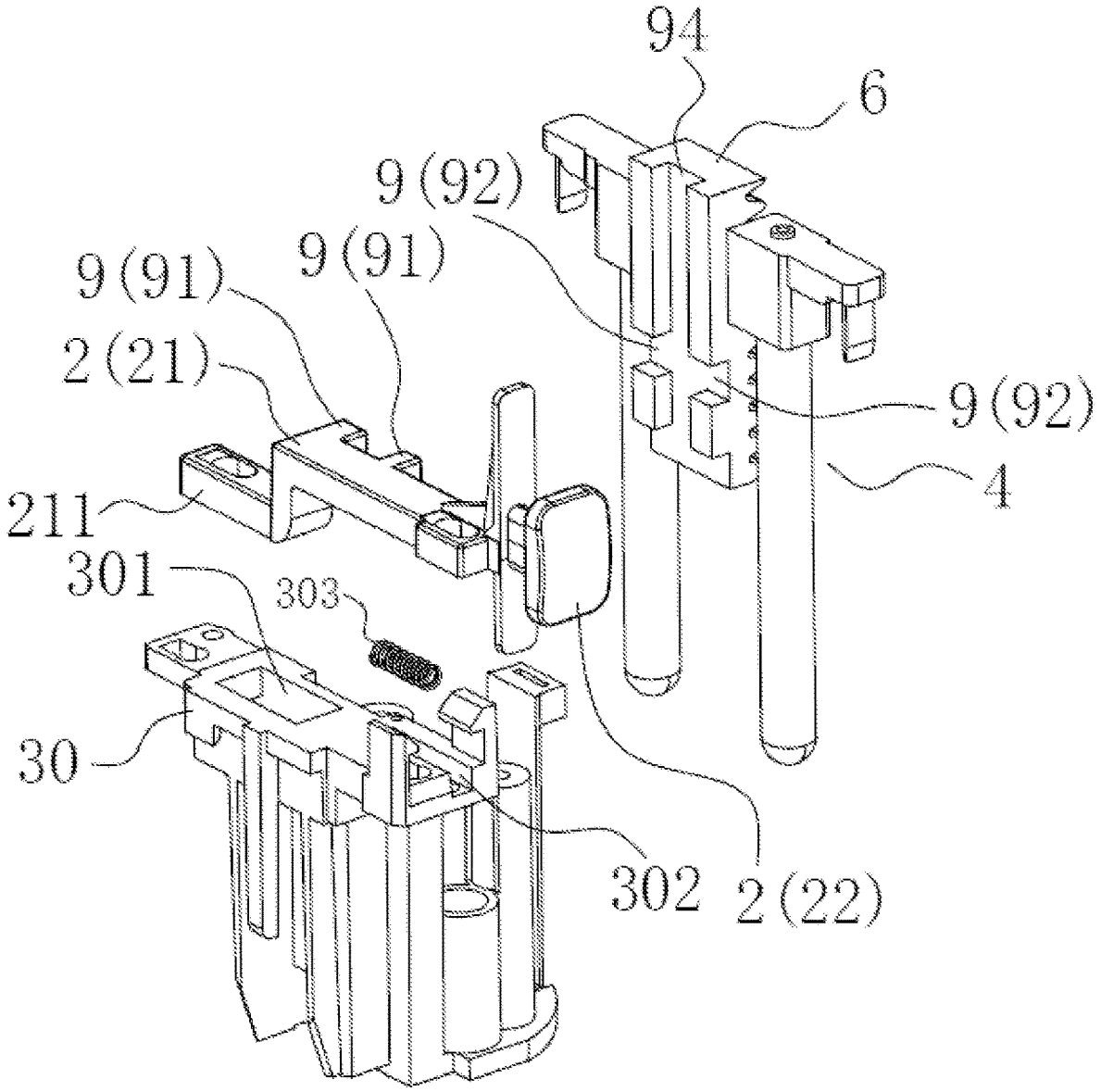
FIG. 11 is a schematic view showing an exploded structure of the push handle, the movable rack and a positioning seat according to Embodiment 2.
Figure 12:
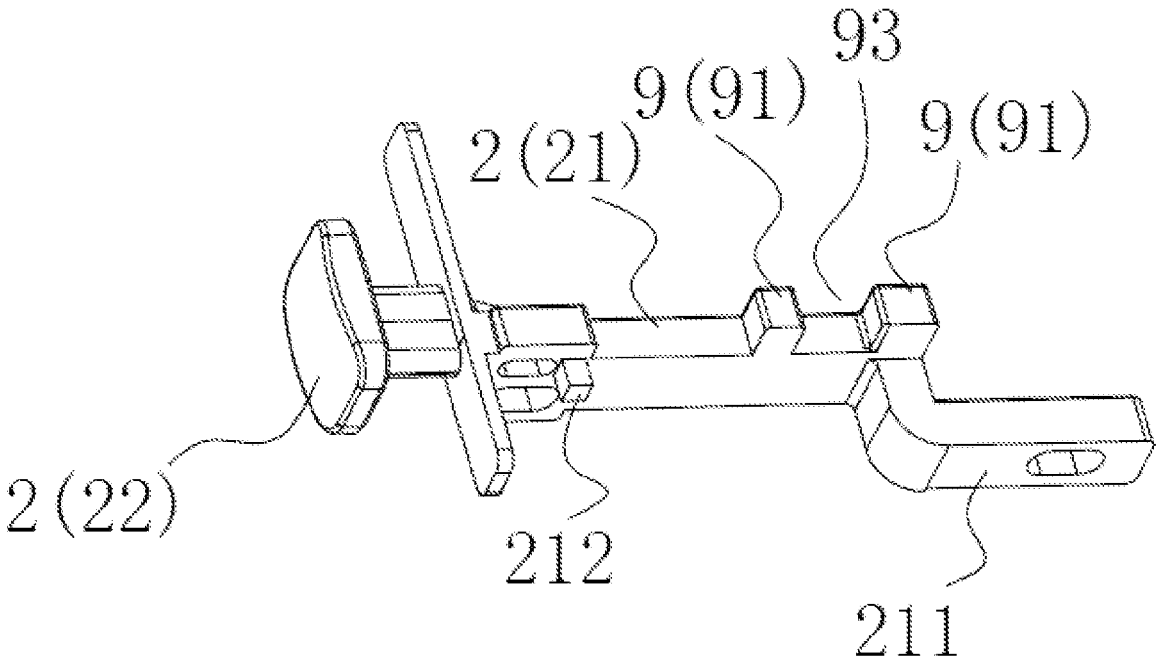
FIG. 12 is a structurally schematic view of the push handle according to Embodiment 2.

The main difference between this embodiment and Embodiment 1 is that, as shown in FIGS. 10 to 12, a locking structure 9 is arranged between the push handle 2 and the movable rack 6 and comprises at least one locking protrusion 91 arranged on the push handle 2 and at least one locking slot 92 formed on the movable rack 6 and used for clamping the locking protrusion 91. After the two pins 42 of the pin assembly 4 and the plug bush 3 extend out of the shell 1 or are retracted into the shell 1, the two pins 42 and the plug bush 3 of the pin assembly 4 can be clamped into the locking slot 92 by the locking protrusion 91 of the locking structure 9, so that the movable rack 6 and the pin assembly 4 can be integrally locked, which is convenient for the product use. For example, after the two pins 42 of the pin assembly 4 and the plug bush 3 extend out of the shell 1, the locking protrusions 91 of the locking structure 9 are clamped into the locking slot 92, so that the movable rack 6 and the pin assembly 4 are integrally locked, and the movable rack 6 and the pin assembly 4 cannot be automatically retracted, which is convenient for the product use; and the two pins 42 of the pin assembly 4 and the plug bush 3 can be retracted into the shell 1 only if the locking protrusion 91 leaves the locking slot 92 to release the locking by pushing the push handle 2. Similarly, after the two pins 4 of the pin assembly 42 and the plug bush 3 are retracted into the shell 1, the locking protrusion 91 of the locking structure 9 is clamped into the locking slot 92, so that the movable rack 6 and the pin assembly 4 are integrally locked, and the two pins 42 and the plug bush 3 cannot extend out automatically; and the two pins 42 and the plug bush 3 can be pushed out of the shell 1 only if the locking protrusion 91 leaves the locking slot 92 to release the locking by pushing the push handle 2.

Specifically, the number of the locking protrusions 91 in the embodiment is two, and an avoiding slot 93 is formed between the two locking protrusions 91; accordingly, the number of the locking slot 92 is also two; and a longitudinal slide slot 94 extending longitudinally is formed in the movable rack 6, and the two locking slots 92 are located at both sides of the longitudinal slide slot, as shown in FIGS. 11 and 12. In a locked state, the two locking protrusions 91 are clamped into the two locking slots 92 one by one; and in a contact locked state, one locking protrusion 91 is located in the longitudinal slide slot 94, and the other locking protrusion 91 is also moved to the side of the movable rack 6.

In the embodiment, the push handle 2 is movably connected with the plug bush 3 by a positioning seat 30, and a positioning slide hole 301 and a spring mounting slot 302 are respectively formed in the positioning seat 30; a positioning strip 211 which is slidably arranged in the positioning slide hole 301 and a push block 212 which is movable in the spring mounting slot 302 are formed in the push handle 2; and a spring 303 is arranged in the spring mounting slot 302, and the spring 303 is directly pushed by the push block 212. In a natural telescopic state of the spring 303, the push handle 2 slides on the positioning seat 30 to the locking protrusion 91 of the locking structure 9 for being clamped into the locking slot 92, so that the movable rack 6 and the pin assembly 4 are integrally locked. When it is required to release the locking, the push handle 2 is pushed into the shell 1, so that the locking protrusion 91 leaves the locking slot 92 to release the locking. Thus, the two pins 42 of the pin assembly and the plug bush 3 can be pushed out and retracted by pushing the push handle 2 up and down 4 while the spring 303 is compressed. After the push handle 2 is pushed up and down to be in place, the acting force on the push handle 2 is released; and under the elastic restoring force of the spring 303, the push handle 2 is moved outwards and reset, so that the push handle 2 slides on the positioning seat 30, and the locking protrusion 91 of the locking structure 9 is clamped into the locking slot 92 again for realizing the locking function.

In the embodiment, as shown in FIGS. 2, 10 and 12, the push handle 2 mainly consists of a linkage block 21 arranged in the shell 1 and a push part 22 connected to an end of the linkage block 21 and passing out of the shell 1, wherein the linkage block 21 is movably connected with the plug bush 3 by the positioning seat 30; and the locking protrusion 91, the positioning strip 211 and the push block 212 are all arranged on the linkage block 21. Therefore, when the linkage block 21 of the push handle 2 moves downwards, the plug bush 3 is driven to move downwards synchronously. Meanwhile, as shown in FIG. 5, a strip-shaped hole 10 for the push part 22 to move up and down is formed in the shell 1, and the strip-shaped hole 10 provides a vertical path for the push part 22 to move up and down.

Figure 3:
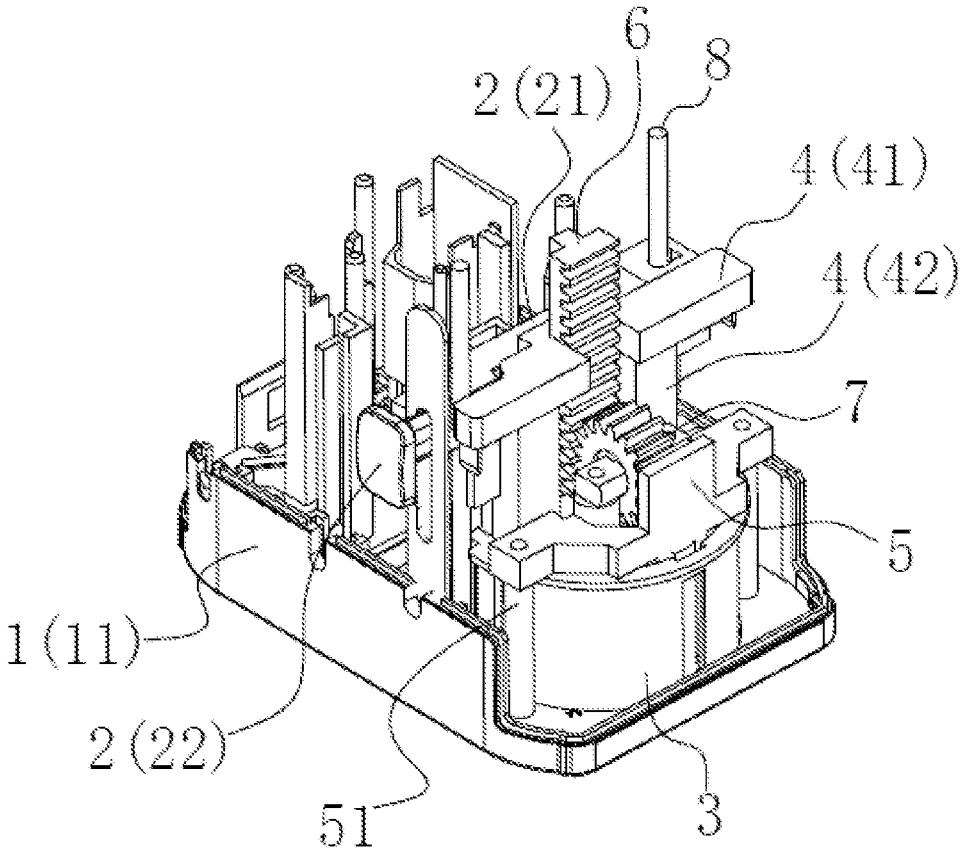
FIG. 3 is a structurally schematic view of a linkage block of a push handle sleeved on a guide rod according to Embodiment 1.

In order to improve the vertical stability of the push handle 2 moving up and down, at least one guide rod 8 is arranged in the shell 1, and the linkage block 21 and the positioning seat 30 are sleeved on the guide rod 8, as shown in FIGS. 3 and 10. When the push handle 2 moves up and down, the linkage block 21 can vertically move up and down along a plurality of guide rods 8, without the phenomena of displacement, bending and the like.

In the description above, only the preferred embodiments of the present invention has been described, and the technical scope of the present invention is not limited in any way. Therefore, other structures obtained by adopting the same or similar technical features as those of the above embodiments of the present invention are within the scope of the present invention.

The invention claimed is:

1. A telescopic mechanism of an European plug of a power converter with a grounding pin, comprising a shell, a push handle arranged on the shell, a plug bush arranged in the shell and movably connected with the push handle, and a pin assembly arranged in the shell; characterized by further comprising a fixed rack arranged on the shell and extending into the plug bush, a movable rack connected with the pin assembly; and a gear arranged on the plug bush and meshed with the fixed rack and the movable rack respectively; wherein the pin assembly comprises two pins; two ground conductors are arranged on the plug bush, the two pins and the two ground conductors are combined to form a hybrid grounding plug, and an additional contact sleeve is provided on the hybrid grounding plug for a grounding pin of a French plug.

2. The telescopic mechanism of an European plug of a power converter with a grounding pin according to claim 1, wherein the movable rack is fixedly connected with the pin assembly.

3. The telescopic mechanism of an European plug of a power converter with a grounding pin according to claim 2, wherein the pin assembly further comprises a transverse connection block, and the two pins are perpendicularly arranged at a lower end of the transverse connection block, wherein the movable rack is fixedly connected with the transverse connection block.

4. The telescopic mechanism of an European plug of a power converter with a grounding pin according to claim 1, wherein the gear is fixed to the plug bush.

5. The telescopic mechanism of an European plug of a power converter with a grounding pin according to claim 4, wherein the gear is fixed to the plug bush by a screw.

6. The telescopic mechanism of an European plug of a power converter with a grounding pin according to claim 1, wherein the shell comprises a base and an upper cover matched with the base, wherein an opening through which the plug bush and the pin assembly pass is formed in the base.

7. The telescopic mechanism of an European plug of a power converter with a grounding pin according to claim 6, wherein the fixed rack is integrally formed on the base, or longitudinally and fixedly mounted on the base by a connector.

8. The telescopic mechanism of an European plug of a power converter with a grounding pin according to claim 6, wherein the fixed rack is longitudinally fixed to the upper cover.

9. The telescopic mechanism of an European plug of a power converter with a grounding pin according to claim 1, wherein a locking structure is arranged between the push handle and the movable rack and comprises at least one locking protrusion arranged on the push handle and at least one locking slot formed on the movable rack and used for clamping the locking protrusion.

10. The telescopic mechanism of an European plug of a power converter with a grounding pin according to claim 9, wherein the push handle is movably connected with the plug bush by a positioning seat, and a positioning slide hole and a spring mounting slot are respectively formed in the positioning seat; and a positioning strip which is slidably arranged in the positioning slide hole and a push block which is movable in the spring mounting slot are formed in the push handle, and a spring is arranged in the spring mounting slot.

11. The telescopic mechanism of an European plug of a power converter with a grounding pin according to claim 10, wherein the push handle mainly consists of a linkage block arranged in the shell and a push part connected to an end of the linkage block and passing out of the shell, wherein the linkage block is movably connected with the plug bush by the positioning seat; the locking protrusion, the positioning strip and the push block are all arranged on the linkage block; meanwhile, a strip-shaped hole for the push part to move up and down is formed in the shell.

12. The telescopic mechanism of an European plug of a power converter with a grounding pin according to claim 11, wherein at least one guide rod is arranged in the shell, and the linkage block and the positioning seat are sleeved on the guide rod.

* * * * *